US010876342B2

(12) United States Patent
Lygin et al.

(10) Patent No.: US 10,876,342 B2
(45) Date of Patent: Dec. 29, 2020

(54) GUIDING RAIL FOR GUIDING A DOOR LEAF BETWEEN AN OPENING POSITION AND A CLOSING POSITION IN RELATION TO A DOOR OPENING IN A WALL

(71) Applicant: dormakaba Deutschland GmbH, Ennepetal (DE)

(72) Inventors: Konstantin Lygin, Ennepetal (DE); Sven Busch, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 125 days.

(21) Appl. No.: 16/130,091

(22) Filed: Sep. 13, 2018

(65) Prior Publication Data

US 2019/0093406 A1 Mar. 28, 2019

(30) Foreign Application Priority Data

Sep. 25, 2017 (EP) ..... 17193023

(51) Int. Cl.
*E05F 3/22* (2006.01)
*E05F 15/72* (2015.01)
*E05F 15/63* (2015.01)

(52) U.S. Cl.
CPC ..... *E05F 3/227* (2013.01); *E05F 3/22* (2013.01); *E05F 15/72* (2015.01); *E05F 2003/228* (2013.01); *E05F 2015/631* (2015.01); *E05Y 2201/684* (2013.01); *E05Y 2400/654* (2013.01); *E05Y 2900/132* (2013.01)

(58) Field of Classification Search
CPC ... E05F 2015/631; E05F 15/627; E05F 3/227; E05Y 2400/654
See application file for complete search history.

(56) References Cited

U.S. PATENT DOCUMENTS 7,910,832 B2 * 3/2011 Pieh ..... E05F 15/655 174/99 R
2005/0095903 A1 * 5/2005 Stenzel ..... B60R 16/0215 439/501

FOREIGN PATENT DOCUMENTS

DE 19717993 A1 * 10/1998 ..... E05F 5/00
DE 19809909 A1 * 9/1999 ..... E05F 3/222
DE 19809909 A1 9/1999
DE 10329562 A1 * 2/2005 ..... E05F 15/611
EP 0764752 A2 * 3/1997 ..... E05B 47/0009
(Continued)

*Primary Examiner* — Marcus Menezes
(74) *Attorney, Agent, or Firm* — Cantor Colburn LLP

(57) ABSTRACT

A guiding rail for guiding a door leaf between an opening position and a closing position in relation to a door opening in a wall includes: at least one guiding section with a guiding compartment, in which a sliding element is accommodated to be movable, wherein the guiding section includes a guiding opening, through which a bearing axis of the sliding element exits at least partially from the guiding compartment, at which axis a lever element is supportable to be rotationally movable, in order to establish an operative connection between the sliding element and the door leaf. The guiding rail further includes at least one functional section with a functional compartment, in which a transmission means is receivable, which serves for transferring electrical energy and/or data between at least a wall-sided energy source and a door leaf-sided energy recipient and a labyrinth guide between the guiding and functional compartments.

10 Claims, 3 Drawing Sheets

(56) References Cited

FOREIGN PATENT DOCUMENTS

| | | | | |
|---|---|---|---|---|
| EP | 2476849 | A2 | 7/2012 | |
| EP | 2787156 | A2 | 10/2014 | |
| EP | 3064694 | A1 * | 9/2016 | ..... E05F 15/63 |
| EP | 3064694 | A1 | 9/2016 | |

* cited by examiner

GUIDING RAIL FOR GUIDING A DOOR LEAF BETWEEN AN OPENING POSITION AND A CLOSING POSITION IN RELATION TO A DOOR OPENING IN A WALL

TECHNICAL FIELD

The following disclosure relates to a guiding rail for guiding a door leaf between an opening position and a closing position in relation to a door opening in a wall according to the generic part of the independent device claim. Furthermore, the disclosure relates to a system for at least partially actuating a door leaf between an opening position and a closing position having a corresponding guiding rail and a device for driving the door leaf at least partially during the transfer of the door leaf from the opening position into the closing position according to the generic part of the system claim.

BACKGROUND

Guiding rails for guiding a door leaf between an opening position and a closing position are generally well known. Often such guiding rails are employed together with devices for at least partially automatically driving a door leaf. Such devices may drive the door leaf by means of an electrical drive either fully automatically or at least may assist or slow down the movement of the door leaf during the transfer of the door leaf from the opening position into the closing position. Often electric energy, in particular power, is used for driving automatic or partially automatic devices. Moreover, devices are known, which are configured as pure door closers, and which are able to accumulate a closing energy, for example by means of a pre-stressed spring when opening the door leaf, in order to transfer the door leaf from the opening position into the closing position. Often, at least one data connection is realized between the door leaf and a door casing at a wall for monitoring and/or controlling automatic, partially automatic or purely mechanical devices. Mostly, the power and/or data are conducted between the door leaf and the door casing via a transmission means and there between via the guiding rail. The transmission means may be configured in the shape of a cable, and may be run within the guiding rail. However, the guiding rail is open to the outside, in order to establish a connection to a lever element, which serves as a transmission member between a sliding element, which is displaceably movable along the guiding rail, and the door leaf. Therefore, the transmission means within the open guiding rail is exposed to the risk of damages. Damaging the transmission means may result in interruption of current and/or data transmission, and thus compromise the functioning of the devices.

SUMMARY

The present disclosure overcomes at least in part the above-described disadvantages in a guiding rail for guiding a door leaf. In particular, the present disclosure provides a guiding rail for guiding a door leaf, which has a simple structure, allows for an inexpensive and simple mounting, and which is able to accommodate a transmission means in a manner inaccessible from the outside such that the transmission means is reliably protected against damages. Furthermore, the disclosure provides a corresponding system for at least partially automatically actuating a door leaf having a corresponding guiding rail, and a device for driving the door leaf at least partially during the transfer of the door leaf from the opening position into the closing position.

The disclosure provides for a guiding rail for guiding a door leaf between an opening position and a closing position in relation to a door opening in a wall, including: at least one guiding section with a guiding compartment, in which a sliding element is movably accommodated, wherein the guiding compartment includes a guiding opening, through which a bearing axis of the sliding element exits at least partially from the guiding compartment, at which axis a lever element is bearable rotationally movable, in order to establish an operative connection between the sliding element and the door leaf, at least one functional section with a functional compartment, in which a transmission means is receivable, which serves for transmitting electrical energy and/or data between at least one wall-sided energy source and a door leaf-sided energy recipient. According to the disclosure, it is intended for this purpose that a labyrinth guide be configured between the guiding compartment and the functional compartment, in order to connect the sliding element mechanically and/or electrically to the transmission means, wherein the labyrinth guide is disposed at a distance to a longitudinal extension axis of the guiding opening such that the labyrinth guide is located outside an intrusion sector into the guiding compartment through the guiding opening.

The lever element is disposed at the sliding element to be rotationally movable, which is guided along the guiding rail. The transmission means is placed for example with a length compensation within the guiding rail, then electrically and/or mechanically connected to the sliding element, and, via the sliding element, guided to the lever element. In this case, the guiding rail may be disposed on a casing side of the wall or on the door leaf, and for example have a horizontal extension. Advantageously, in this case the sliding element may slide almost without friction in the guiding rail. Thus, the sliding element serves for assisting at least partially the movement of the door leaf between the opening position and the closing position. Simultaneously at another end, the lever element performs a rotary movement around a drive axis of rotation, at which a spring element may be provided, in order to accumulate a closing energy during the movement of the door leaf from the closing position into the opening position, which energy, during the movement of the door leaf back into the closing position, may be at least partially released again. Moreover, it is conceivable that the sliding element be configured spring-loaded and guidable by a spring.

The inventive idea in this case relates to providing a labyrinth-type guide in the inside of the guiding rail, by means of which the sliding element may be electrically and/or mechanically connected to the transmission means. In this case, the labyrinth guide is positioned to be inaccessible from the outside, outside of the intrusion sector into the guiding compartment through the guiding opening, in order to prevent a tool or even a hand from engaging in the guiding rail, in particular in the functional section of the guiding rail, in which the transmission means is laid. In other words, two sections are created within the guiding rail, namely a guiding section for the sliding element, which is open to the outside through the guiding opening, and a functional section, which accommodates the transmission means. The labyrinth guide forms a transition between the sections, which transition, however, is disposed offset with regard to the guiding opening so that no tool nor hand may reach the transmission means through the guiding opening and through the labyrinth guide. In this case, the labyrinth guide may be configured as low as possible and the furthest possible away from the mounting surface of the guiding rail at the wall or at the door leaf, so that during an intervention into the guiding opening, the labyrinth guide is located safely outside the intervention sector into the guiding compartment. Advantageously in this case, the intrusion sector is defined with at least three levels, and namely as far as an eye may look into the guiding rail through the guiding opening, and as far as a hand or tool may reach into the guiding rail through the guiding opening. In this case, the labyrinth guide may be configured for example as a longitudinal groove between the two sections, which are hidden in the inside of the guiding rail. Moreover, an overhang may be provided between the guiding opening and the labyrinth guide making the access to the labyrinth guide more difficult. The mechanical coupling between the sliding element and the transmission means may be guaranteed and/or configured to be releasable for example by means of pins. Furthermore, such an arrangement of the labyrinth guide may create a free space above the sliding element in the guiding rail, which may be employed as an additional functional section, e.g. for further structural modules, for example a smoke detector, a control and/or regulation module or an electro-magnetic, preferably overridable, arresting device for the sliding element.

Thus, a guiding rail may be created, which, by means of the labyrinth guide hidden in the inside of the guiding rail, provides for a so-called blockade device, respectively a protecting device for the transmission means. Thus, the transmission means may be disposed in the guiding rail, in particular in the functional section of the guiding rail, to be inaccessible from the outside, and thereby be reliably protected against damages.

Furthermore, within the scope of the disclosure, it may be intended in a guiding rail that the labyrinth guide be configured at a walling in the guiding compartment of the guiding section, which essentially extends parallel to and at a distance to an extension plane of the wall. Advantageously thereby, the walling is able to separate the guiding section from the functional section. Furthermore thereby, the advantage may be achieved that the labyrinth guide may be shifted away from the mounting surface at the wall or at the door leaf, in order to delimit the intervention sector into the guiding rail through the guiding opening. In the event a tool may not be inclined further than to the mounting surface, because it impacts against the wall, a potential maximum intervention angle is delimited at an edge of the guiding opening to the mounting surface. Thereby, the intervention sector into the guiding rail through the guiding opening is reduced. Moreover, the intervention lever at the border of the guiding opening is delimited so that the force during the intervention into the guiding rail is likewise limited.

Furthermore, the disclosure may intend that, seen in cross-section of the guiding section, the labyrinth guide be configured at a lower blockade area of the guiding section, which is inaccessible through the guiding opening. Thus, the advantage is achieved that the labyrinth guide be positioned further away from the intervention sector into the guiding rail. The deeper the labyrinth guide is located in this case, the more difficult an unauthorized intervention into the guiding rail will be. Thus, the blockade effect, respectively the protective effect of the labyrinth guide may be improved.

Furthermore, within the scope of the disclosure, it may be intended at a guiding rail that the functional section include a common walling with the guiding section, which walling extends in a transverse direction to an extension plane of the wall, and at the edge thereof the guiding opening forms. Thus, the common walling delimits the guiding compartment and closes-off the functional compartment from the bottom.

Moreover, within the scope of the disclosure, it may be intended in a guiding rail that the functional section, in particular the walling of the functional section, which walling is configured jointly with the guiding section, includes a projection, which engages in the guiding opening, and which determines, preferably delimits the intrusion sector into the guiding compartment. In other words, the projection may project so far that the distance between the guiding opening and the wall is even further reduced. Thereby moreover, both the intervention angle and the intervention lever are reduced at the border of the guiding opening. Consequently, the labyrinth guide is placed further distant from the longitudinal extension axis of the guiding opening in the direction away from the wall. Thus, the blockade effect, respectively the protective effect of the labyrinth guide may be increased.

In addition within the scope of the disclosure, it may be intended in a guiding rail that a connecting element be positively and/or non-positively attached to the sliding element, preferably releasably, which is accommodated in the labyrinth guide to be movable, in order to mechanically and/or electrically connect the sliding element to the transmission means, preferably reversibly, and/or in that the connecting element includes a plug-in connection for the transmission means. Thus, a simple mounting of the guiding rail and a simple connection of the sliding element to the transmission means are made possible. For this purpose, the mechanic installer just would need to attach, respectively latch the connecting element at the sliding element, and subsequently, plug-in the transmission means into the plug-in connection at the connecting element. In addition thereby, the advantage may be achieved that different components of the guiding rail, in particular the sliding element may be easily exchanged, for example during repair and/or maintenance.

Furthermore, the disclosure may provide for a gearing in the functional compartment of the functional section, in order to provide for a length compensation for the transmission means during a movement of the sliding element along the guiding section. As the transmission means is mechanically and/or electrically connected to the sliding element in any position thereof in the guiding rail, the transmission means should have such a length to run as far as to the stationary wall-sided energy source in a most distant position of the sliding element in the guiding rail. In another closer position of the sliding element to the stationary wall-sided energy source, an excess in length of the transmission means may be given, for example in the shape of a loop. Advantageously in this case, the gearing may ensure that the excess in length of the transmission means is fold- and kink-free turned-over, such as not to create any jamming within the functional section.

Furthermore, it is conceivable the gearing be configured as a pulley block gearing. Such a gearing is simple and inexpensive, and may ensure in an advantageous manner for a length compensation of the transmission means during a movement of the sliding element along the guiding section.

Furthermore, it is conceivable that at least the guiding section, the functional section or another functional section in the shape of a standardized structural component for assembling the guiding rail be configured in the shape of an assembly kit. Thus, the advantage may be achieved that the guiding rail may be employed with various systems for actuating the door leaf, which may include devices for automatically, partially automatically and/or mechanically driving the door leaf. Moreover, it is advantageous that thus even existing guiding rails may be retrofitted with an inventive functional section. According to another advantage, the user may moreover decide, which sections s/he may want to use, and at which installations. Thus for example, a guiding rail in a private area may be configured more economically, for example without the functional section with a labyrinth guide, than the guiding rail for the use in a public area, which needs to be better protected. According to the principle of the assembly kit, the functionality of the guiding rail may be even expanded more with a further functional section, for example for an arrangement of a smoke detector, a control and/or regulation module, and/or an arresting device for the sliding element in a predetermined position within the guiding rail.

Moreover, the disclosure may provide for the functional section, seen in a transverse direction to an extension plane of the wall, to be located further distant from the wall than the guiding section, which bears against the wall. Thus, the functional section may be attacked only from the side of the wall, wherein the distance to the wall delimits the intervention lever and the potential intervention angle into the guiding opening of the guiding section in such a manner that the functional section is located outside the intervention sector into the guiding rail. Thereby, an effective protection against vandalism may be provided for the transmission means.

Moreover, within the scope of the disclosure, it may be intended that the functional section seen in a transverse direction with regard to an extension plane of the wall, be disposed neighbouring the guiding section. Thereby, the distance of the functional section to the wall may be reduced, whereby the intervention lever is even further delimited through the guiding opening. Consequently, the blockade effect, respectively the protective effect may be improved at the labyrinth guide without the guiding rail.

Furthermore, the disclosure may provide for that at least one further functional section with a further functional compartment be provided, in which at least one arresting device for arresting the door leaf in an arresting position between the opening position and the closing position, a smoke detector and/or a control and/or regulating unit be disposed for at least partially automatically actuating the door leaf. Thus, the functionality of the guiding rail may be expanded. In this case, it is conceivable that the further functional section be disposed next to the functional section with the transmission means or above the guiding section.

Furthermore, within the scope of the disclosure, it may be intended that a further functional section with a further functional compartment be disposed in a plane parallel to an extension plane of the wall above the guiding section. By disposing the inventive labyrinth guide at the bottom in the guiding compartment and spaced apart to the longitudinal extension axis of the guiding opening, advantageously a free space is created above the sliding element, which again may be employed as a further functional compartment. Advantageously thereby, an arresting device may be disposed in the further functional compartment, which may be overridable in an advantageous manner for the sliding element.

Furthermore, within the scope of the disclosure, it may be intended that a functional opening be configured between the guiding compartment and the further functional compartment, in order to provide a mechanical and/or electrical connection to the sliding element. Thereby, the operative connection to the sliding element may be provided, for example for the case to have the sliding element latch at an arresting device.

Moreover, within the scope of the disclosure, it is conceivable that the transmission means be configured at least section-wise as a flat cable, flat ribbon cable or as a flexible printed circuit board, and/or the transmission means be configured at least section-wise as a round cable. A flat cable, respectively a flat ribbon cable is a multiple-wire cable, in which the individual wires are laid parallel next to each other. Multiple-wire flat ribbon cables have the advantage of connecting multiple wires at once, instead of soldering them individually in an insulated manner. It is likewise conceivable that the flat cables, respectively flat ribbon cables be configured with a shielding, which in particular may include aluminium or copper film. A flexible printed circuit board may be a printed circuit, which in particular is built up on flexible plastic material carriers. In this case, copper may be employed as the conductor material. Moreover, likewise round cables, as the transmission means are conceivable, which have a circular cross-section, and in which the individual wires are disposed in a round manner around the centre. Round cables may have the same function as flat cables, respectively as flat ribbon cables. Advantageously, flat ribbon cables may be simply twisted and/or deflected, because the individual conductors experience little kinking during twisting and/or deflecting a flat cable. For example, with a bending radius of approximately 5 mm, a flat ribbon cable may have a service life of at least 200,000 bending cycles, with a bending radius of approximately 8 mm it may have a service life at least 2 millions of bending cycles. With the largest possible bending radius, a mechanical stress of the transmission means is reduced, and thus the service life of the transmission means may be considerably increased.

Furthermore, the advantages are achieved by providing a system for at least partially automatically actuating a door leaf between an opening position and a closing position, including: a device for driving the door leaf at least partially during the transfer of the door leaf from the opening position into the closing position, and a guiding rail, which may be configured as described above. In this case, the same advantages are achieved, which are described above in conjunction with the inventive guiding rail, to which presently reference is fully made. In addition, it is advantageous that the system for actuating the door leaf may be configured with different devices for automatically, partially automatically and/or mechanically driving the door leaf.

BRIEF DESCRIPTION OF THE DRAWINGS

Hereinafter, further measures enhancing the disclosure will be illustrated in detail in conjunction with the description of the preferred exemplary embodiments of the disclosure based on the Figures. In this context, the features mentioned in the claims and in the description may be essential to the disclosure individually or in any arbitrary combination. In this case, it should be noted that the Figures do have a descriptive character only and are not intended to delimit the disclosure in any way. In the drawings:

DETAILED DESCRIPTION OF THE DRAWINGS

Figure 1A:
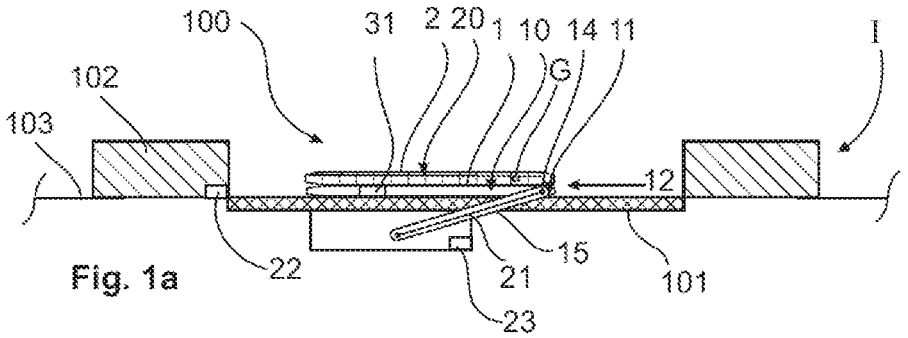
FIG. 1*a* shows a door leaf with an inventive guiding rail in a closing position.

Throughout FIGS. 1-4, same parts of the inventive guiding rail 100 and of the inventive system 110 are always identified by the same reference numerals, and therefore, normally they will be only described once.

Figure 1B:
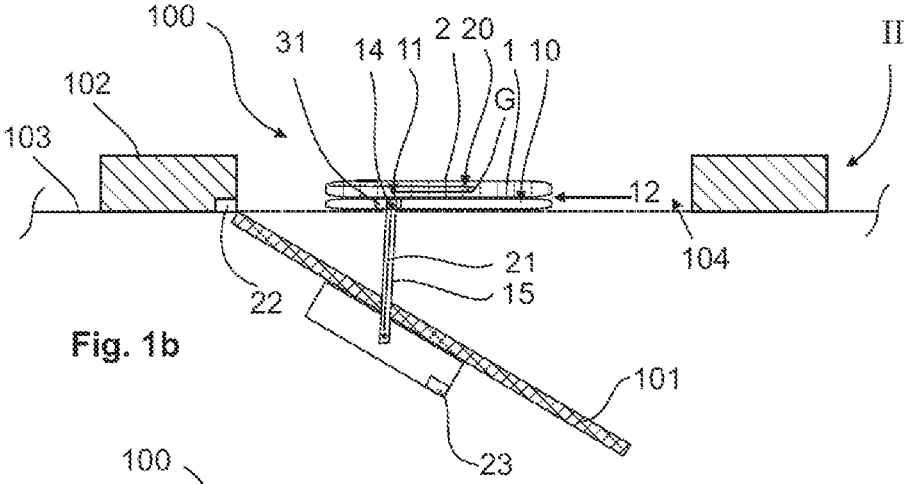
FIG. 1*b* shows a door leaf with an inventive guiding rail in an arresting position.
Figure 1C:
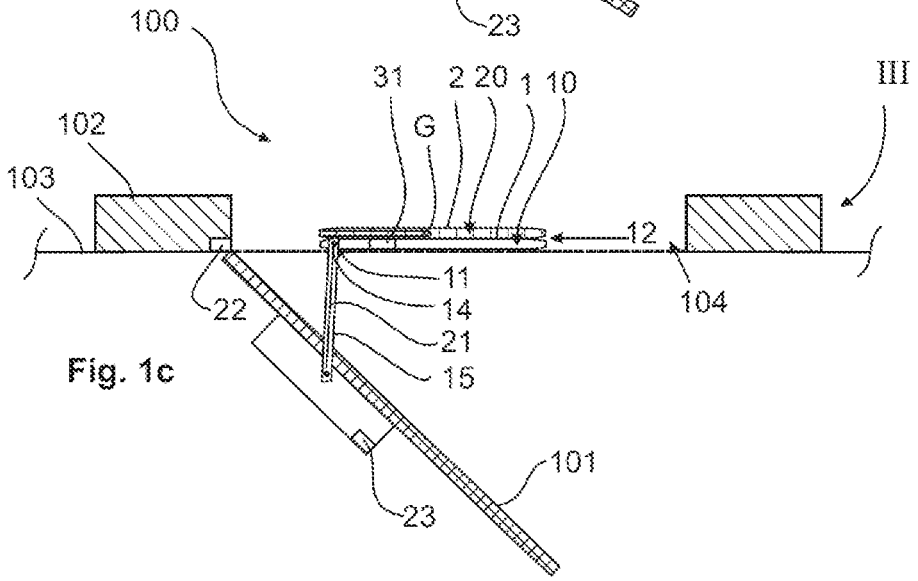
FIG. 1*c* shows a door leaf with an inventive guiding rail in an opening position.

The FIGS. 1*a*, 1*b*, and 1*c* show a door leaf 101 initially in a closing position I in the view of FIG. 1*a*, then in an optional arresting position II in the view of FIG. 1*b*, and finally in an opening position III in the view of FIG. 1*c*. In the opening position III, the door leaf 101 is pivoted open to the maximum, and opens up a door opening 104 in a wall 103, which is delimited by means of a door casing 102. In this case, the guiding rail 100 serves for assisting the movement of a door leaf 101 between the opening position III and the closing position I in relation to the door opening 104 in the wall 103.

In this case, the guiding rail 100 includes at least one guiding section 1 with one guiding compartment 10, in which a sliding element 11 is movably accommodated, and at least one functional section 2 with a functional compartment 20, in which a transmission means 21 is receivable, which serves for transferring electrical energy and/or data between at least one wall-sided energy source 22 and a door leaf-sided energy recipient 23. At least section-wise the inventive transmission means 21 may be configured as a flat cable, flat ribbon cable, a flexible printed circuit board or as a round cable.

As shown in the FIGS. 2 and 3 in the following, the guiding section 1 includes a guiding opening 13, through which a bearing axis 14 of the sliding element 11 exits at least partially from the guiding compartment 10, at which axis a lever element 15 is supportable to be rotationally movable, which is illustrated in the FIGS. 1*a* to 1*c*. In this case, the lever element 15 serves for establishing an operative connection between the sliding element 11 and the door leaf 101. Thus, the lever element 15 is disposed at the sliding element 11 to be rotationally movable, which is guided along the guiding rail 100.

The transmission means 21 is placed for example with a length compensation within the guiding rail 100 for example by means of a gearing G illustrated diagrammatically in the FIGS. 1*a* to 1*c*, then electrically and/or mechanical connected to the sliding element 11, and, via the sliding element 11, guided to the lever element 15. As, in any position of the sliding element 11 in the guiding rail 100, the transmission means 21 is mechanically and/or electrically connected to the sliding element 11, the transmission means 21 has such a length to run as far as to the stationary wall-sided energy source 22 even in a most distant position of the sliding element 11, as shown in FIG. 1*a*. In another closer position of the sliding element 11, an excess of length of the transmission means 21 may be given, for example in the shape of a loop. Advantageously in this case, the gearing G may ensure that the excess in length of the transmission means 21 is fold- and kink-free turned over, such as not to create any jamming within the functional section 2. Within the scope of the disclosure, it is conceivable that the gearing G be configured as a pulley block gearing.

In the FIGS. 1*a* to 1*c*, the guiding rail 100 is illustrated on a casing side of the wall 103. However, it is equally conceivable to dispose the guiding rail 100 on the door leaf 101. The guiding rail 100 may present for example a horizontal course. In this case, the sliding element 11 may move within the guiding rail 100. Simultaneously, the lever element 15 at another end performs a rotary movement around a drive axis of rotation, at which a spring element may be provided, which is not illustrated in detail, in order to accumulate a closing energy during the movement of the door leaf 101 from the closing position I into the opening position III, which energy, during the movement of the door leaf 101 back into the closing position I, may be at least partially released again. As an alternative or in addition, it may be intended that the sliding element 11 be configured likewise spring-loaded and may be guided by means of a spring.

Figure 2:
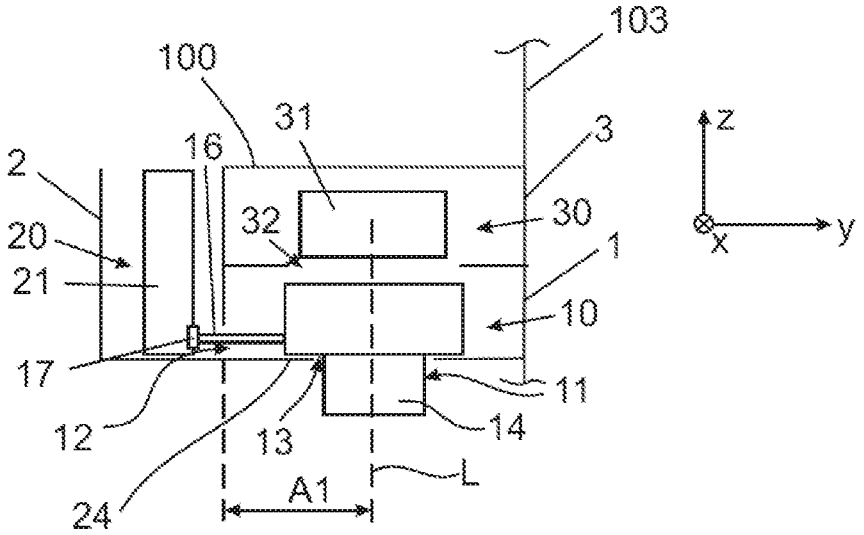
FIG. 2 shows an inventive guiding rail in cross-section with a transmission means in a functional compartment, and a sliding element in a guiding compartment, as well as an optional arresting device in a further functional compartment.
Figure 3:
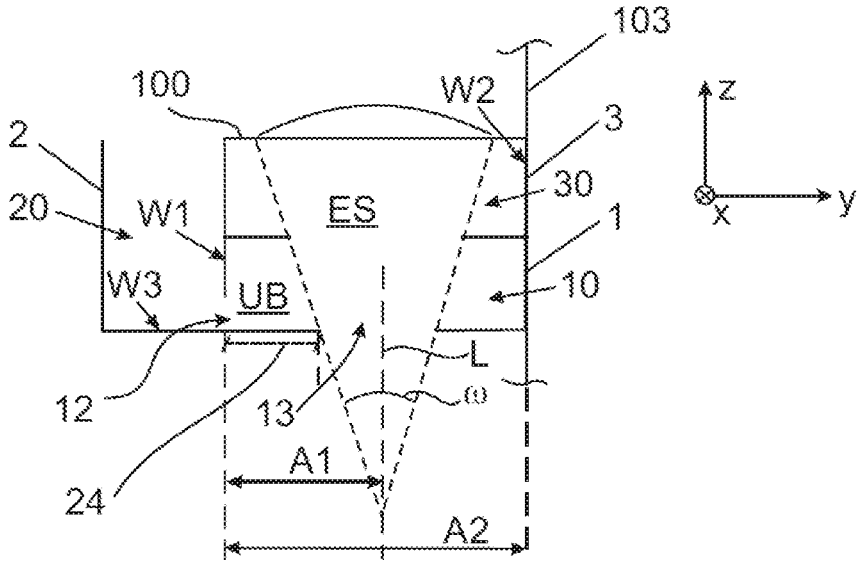
FIG. 3 shows an inventive guiding rail in cross-section.

As revealed in the FIGS. 2 and 3, a labyrinth guide 12 is configured between the guiding compartment 10 and the functional compartment 20, in order to mechanically and/or electrically connect the sliding element 11 to the transmission means 21, for example by means of a connecting element 16, which is releasable disposed at the sliding element 11. In this case, the connecting element 16 may be positively and/or non-positively attached to the sliding element 11, for example latched in. The connecting element 16 is guided to be longitudinally displaceable in the labyrinth guide 12, and during the movement of the sliding element 11 within the guiding section 1, it remains mechanically and/or electrically connected to the transmission means 21. From the side of the transmission means 21, the connecting element 16 may include a plug-in connection 17 for the transmission means 21.

The inventive idea will be explained based on the FIG. 3, according to which the labyrinth guide 12 is disposed in such a manner with a distance A1 to a longitudinal extension axis L of the guiding opening 13 that it is located outside an intrusion sector ES into the guiding compartment 10 through the guiding opening 13. Thereby, an intervention with a tool or even with a hand into the guiding rail 100, in particular into the functional section 2 of the guiding rail 100 may be prevented, or the view into the functional section 2 of the guiding rail 100 may be prevented, in which the transmission means 21 is laid.

In this case, the guiding section 1 and the functional section 2 are created within the guiding rail 100, wherein the guiding section 1 for the sliding element 11 is open to the outside through the guiding opening 13, and wherein the functional section 2 for the transmission means 21 is configured to be inaccessible and hidden, respectively non-visible from the outside. The labyrinth guide 12 forms a transition between the two sections 1, 2, which transition, however, is disposed offset with regard to the guiding opening 13 that no tool nor hand may reach the transmission means 21 through the guiding opening 13 and through the labyrinth guide 12. Furthermore, such an arrangement of the labyrinth guide 12 may create a free space above the sliding element 11 in the guiding rail 100, which space may be employed as an additional functional compartment 30 of an additional functional section 3, e.g. for further structural modules, such as a smoke detector, a control and/or regulation module or an electro-magnetic arresting device 31 for the sliding element 11. The arresting device 31 may retain the door leaf 101, for example in the arresting position II, which is shown in FIG. 1*b*, in that the arresting device 31 arrests the sliding element 11 within the guiding rail 100. For establishing an operative connection between the sliding element 11 and the arresting device 31, a functional opening 32, for example in the shape of an oblong hole, may be configured between the guiding section 1 and the further functional section 3. Advantageously, the sliding element 11 may override the arresting device 31, such that an arresting is even conceivable in several positions of the door leaf 101.

Thereby, the inventive guiding rail 100 is configured with a hidden labyrinth guide 12 in the inside of the guiding rail 100, which thus forms a so-called blockade device, respectively a protecting device for the transmission means 21, and thus reliably protects the transmission means 21 against damages.

As furthermore shown in FIG. 3, the labyrinth guide 12 is configured at a walling W1 in the guiding compartment 10 of the guiding section 1, which essentially extends parallel to and at a distance A2 to an extension plane x, z of the wall 103. In this case, the walling W1 separates the guiding section 1 from the functional section 2. In the view of FIG. 3, the labyrinth guide 12 is offset to the left, respectively away from the extension plane x, z of the wall 103, in order to delimit the intervention sector ES into the guiding rail 100 through the guiding opening 13. In the event a tool may not be inclined further than to the wall 103, because it impacts at the wall 103, moreover, a potential maximum intervention angle to the wall 103, as well as a potential intervention lever at the left border of the guiding opening 13 is delimited in relation to the wall 103. For example, in FIG. 3 an opening angle w is shown, which is determined for example by the fact how far an unauthorized individual may see with the naked eye, respectively reach with a hand and/or with a tool into the guiding rail 100.

As moreover visible from FIG. 3, seen in cross-section of the guiding rail 100, the labyrinth guide 12 is configured at a lower blockade area UB of the guiding section 1, which is inaccessible through the guiding opening 13. The deeper the labyrinth guide 12 is located in this case, the more difficult an unauthorized intervention into the guiding rail 100 will be.

In the lower area of the guiding rail 100, a common walling W3 is provided for the functional section 2 and the guiding section 1, which wall extends in a transverse direction y with regard to the extension plane x, z of the wall 103, and which, at an edge, delimits the guiding opening 13, which is located on the right in the view of FIG. 3. In this case, the common walling W3 does not only delimit the guiding compartment 10, but also moreover closes off the functional compartment 20 from the bottom.

Said walling W3 common to the functional section 2 with the guiding section 1 is provided with a projection 24, which engages into the guiding opening 13, and determines, preferably delimits the intrusion sector ES into the guiding compartment 10. The projection 24 may engage as far into the guiding opening 13 that the distance between the longitudinal extension axis L of the guiding opening 13 and the wall 13, and thereby the potential intervention angle through the guiding opening 13, may be even further reduced. Consequently, likewise the labyrinth guide 12 is placed further away from the longitudinal extension axis L of the guiding opening 13 in the direction away from the wall 103. Thus, the blockade effect, respectively the protective effect of the labyrinth guide 12 may be reinforced.

As can be seen from the FIGS. 2 and 3, the functional section 2 seen in the transverse direction y with regard to the extension plane x, y of the wall 103 is further distant from the wall 103 than the guiding section 1, which directly with a walling W2 bears against the wall 103. Thus, the functional section 2 may be reached only from the side of the wall 103, wherein the distance A2 to the wall 103 delimits the intervention lever and the potential intervention angle into the guiding opening 13 of the guiding section 1 in such a manner that the functional section 2 is located outside the intervention sector ES into the guiding rail 100.

The functional section 2 is located in the transverse direction y with regard to the extension plane x, z of the wall 103 neighbouring the guiding section 1, in order to reduce the distance A2 of the labyrinth guide 12 to the wall 103.

Furthermore, within the scope of the disclosure, it may be intended that at least the guiding section 1, the functional section 2 or the further functional section 3 in the shape of a standardized structural component for assembling the guiding rail 100 may be configured in the shape of an assembly kit.

Figure 4:
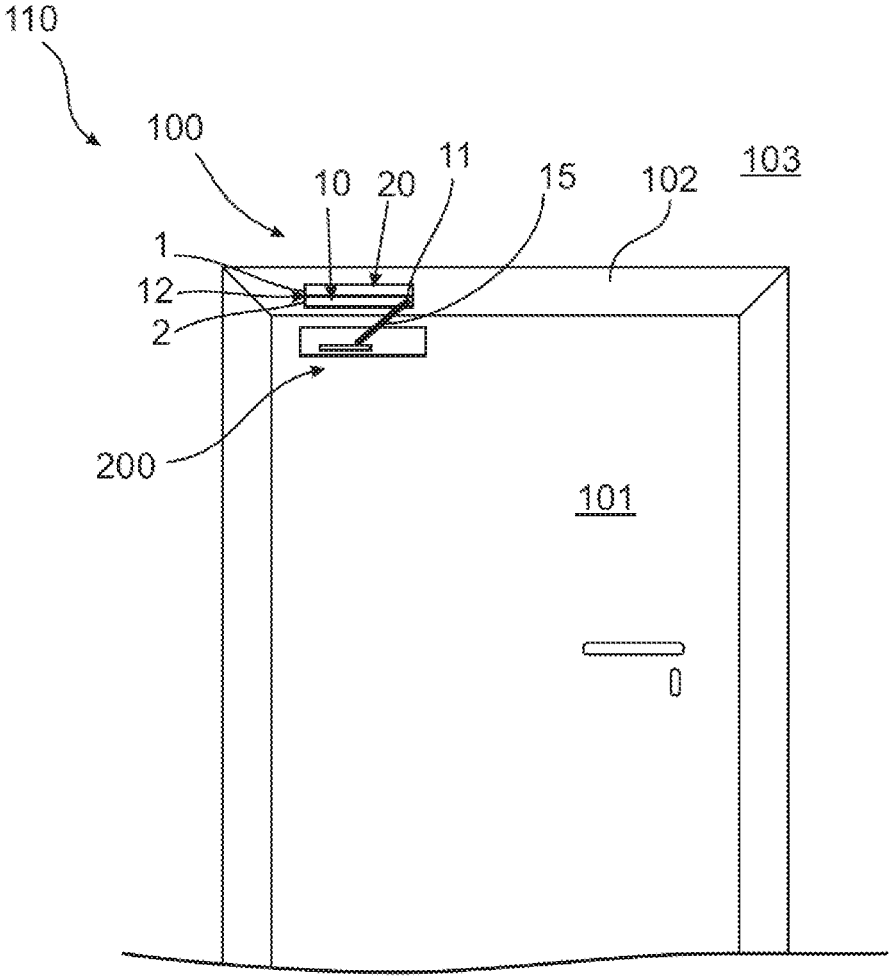
FIG. 4 shows a diagrammatic illustration of an inventive system.

Finally, FIG. 4 shows an inventive system 110 for at least partially automatically actuating the door leaf 101 between the opening position III of the FIG. 1*c* and the closing position I of the FIG. 1*a*. The system 110 comprises a device 200 for driving the door leaf 101 at least partially during the transfer of the door leaf 101 from the opening position III into the closing position I, and a guiding rail 100, which may be configured as described above based on the FIG. 1*a* to 3. In this case, it is advantageous that the system 110 for actuating the door leaf 101 may be configured with different devices 200 for automatically, partially automatically and/or mechanically driving the door leaf 101.

The preceding description of the FIGS. 1*a* to 4 describes the present disclosure exclusively on the basis of examples. Obviously, individual features of the embodiments, as long as technically reasonable, may be freely combined with each other without departing from the scope of the present disclosure.

The invention claimed is:

1. A guiding rail for guiding a door leaf between an opening position and a closing position in relation to a door opening in a wall, the guiding rail comprising:

at least one guiding section with a guiding compartment, in which a sliding element is accommodated to be movable, wherein the guiding section includes a guiding opening, through which a bearing axis of the sliding element exits at least partially from the guiding compartment, at which axis a lever element is supportable to be rotationally movable, in order to establish an operative connection between the sliding element and the door leaf, at least one functional section with a functional compartment configured to receive a transmission means, said transmission means configured to transfer electrical energy or data between at least one wall-sided energy source and a door leaf-sided energy recipient, wherein a guide is located between the guiding compartment and the functional compartment, in order to mechanically or electrically connect the sliding element to the transmission means, wherein the guide is disposed a distance from a longitudinal extension axis of the guiding opening such that the guide is located outside an intrusion sector into the guiding compartment through the guiding opening, wherein the guide is located in a wall in the guiding compartment of the guiding section, wherein the guide essentially extends parallel to an extension plane of the wall, wherein a further functional section with a further functional compartment is disposed in a plane parallel to the extension plane of the wall above the guiding section, or a functional opening is configured between the guiding compartment and the further functional compartment, in order to provide for a mechanical or electrical connection to the sliding element.

2. The guiding rail according to claim 1, wherein seen in cross-section of the guiding section, the guide is configured at a lower blockade area of the guiding section, which is inaccessible through the guiding opening.

3. The guiding rail according to claim 1, wherein the functional section with the functional compartment configured to receive the transmission means includes a wall that is shared with the guiding section, the wall extending in a transverse direction to the extension plane of the wall, and the guiding opening forms at an edge thereof, or the functional section with the functional compartment configured to receive the transmission means includes a projection extending into the guiding opening and is configured to delimit the intrusion sector into the guiding compartment.

4. The guiding rail according to claim 1, wherein a connecting element is releasably connected at the sliding element and is configured to be movable in the guide to mechanically or electrically, connect the sliding element to the transmission means, or the connecting element includes a plug-in connection configured to connect the sliding element to the transmission means.

5. The guiding rail according to claim 1, wherein a gearing is disposed in the functional compartment of the functional section and is configured to accommodate the transmission means during movement of the sliding element along the guiding section, or the gearing is configured as a pulley block gearing.

6. The guiding rail according to claim 1, wherein at least the guiding section, the functional section with the functional compartment configured to receive the transmission means or the further functional section is in a shape of a structural component for assembling the guiding rail and is configured in an assembly kit.

7. The guiding rail according to claim 1, wherein the functional section with the functional compartment configured to receive the transmission means, seen in a transverse direction to the extension plane of the wall, is located further distant from the wall than the guiding section, which bears against the wall, or in that the functional section with the functional compartment configured to receive the transmission means, seen in a transverse direction to an extension plane of the wall, is disposed neighbouring the guiding section.

8. The guiding rail according to claim 1, wherein at least one arresting device for arresting the door leaf in an arresting position between the opening position and the closing position, a smoke detector, or a control, or a regulating unit is disposed in the further functional compartment for at least partially automatically actuating the door leaf.

9. The guiding rail according to claim 1, wherein the transmission means is configured at least as a flat cable, a flat ribbon cable, or a flexible printed circuit board, or the transmission means is configured at least as a round cable.

10. A system for at least partially automatically actuating the door leaf between the opening position and the closing position, including:

a device for driving the door leaf at least partially during the transfer of the door leaf from the opening position into the closing position, and the guiding rail according to claim 1.

* * * * *